United States Patent [19]

Altenschulte et al.

[11] Patent Number: 4,812,130

[45] Date of Patent: Mar. 14, 1989

[54] PRINTED CIRCUIT BOARD WITH MOUNTED TERMINAL

[75] Inventors: Raymond A. Altenschulte, New Palestine; Glen M. Grabow, Indianapolis, both of Ind.

[73] Assignee: RCA Licensing Corp., Princeton, N.J.

[21] Appl. No.: 749,270

[22] Filed: Jun. 27, 1985

[51] Int. Cl.[4] ..... H01R 4/06

[52] U.S. Cl. ..... 439/84; 439/741

[58] Field of Search ..... 339/220 R, 17 C, 220 A, 339/220 C, 220 T, 220 L; 439/84, 741, 870

[56] References Cited

U.S. PATENT DOCUMENTS

| | | | |
|---|---|---|---|
| 1,656,856 | 3/1963 | Gagnon . | |
| 1,874,507 | 8/1932 | Gribbie | 339/220 R |
| 1,912,653 | 6/1933 | Olson | 339/220 R |
| 2,200,059 | 5/1940 | Coyne | 339/17 C |
| 2,438,075 | 6/1962 | Smith | 173/361 |
| 2,587,568 | 2/1952 | Eisler | 339/17 C |
| 2,856,593 | 10/1958 | Gookin | 339/220 R |
| 2,913,634 | 11/1959 | Scoville | 339/220 R |
| 2,941,179 | 6/1960 | Peters | 339/220 R |
| 2,990,533 | 6/1961 | Hughes et al. | 339/220 R |
| 3,025,591 | 3/1962 | Markowitz | 339/220 R |
| 3,106,436 | 10/1963 | Weiss | 339/220 R |
| 3,445,929 | 10/1961 | Wolf | 29/625 |
| 3,845,256 | 10/1974 | Edwards | 339/17 C |
| 4,509,808 | 4/1985 | Hellgren | 339/17 C |

FOREIGN PATENT DOCUMENTS

| | | | |
|---|---|---|---|
| 2304246 | 10/1976 | France | 339/220 R |
| 449395 | 6/1936 | United Kingdom | 339/220 T |

*Primary Examiner*—Gary F. Paumen

*Attorney, Agent, or Firm*—E. M. Whitacre; D. H. Irlbeck; T. H. Magee

[57] ABSTRACT

A printed circuit board has a conductive terminal mounted in an aperture extending therethrough. The terminal has a shoulder portion, adjacent a side surface of the terminal, which contacts one surface of the board adjacent the aperture, and a bottom portion which flares outward to contact a conductive coating disposed, adjacent the aperture, on the opposite surface of the board. The bottom portion is rolled over sufficiently to allow a distal end surface of the bottom portion, adjacent the side surface, to contact the conductive coating at an orientation wherein the distal end surface is substantially parallel to the coating.

11 Claims, 1 Drawing Sheet

Fig. 1
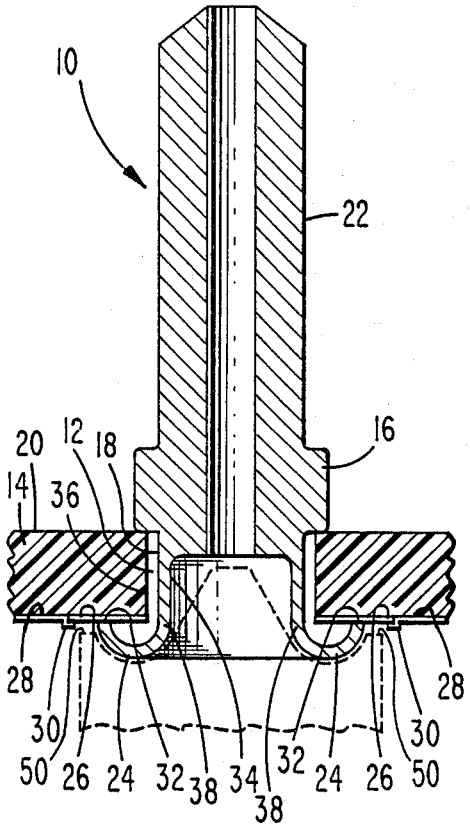
Fig. 2
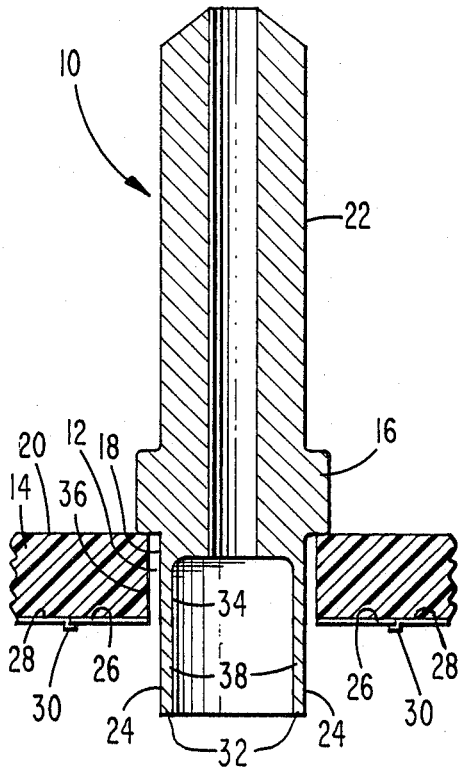
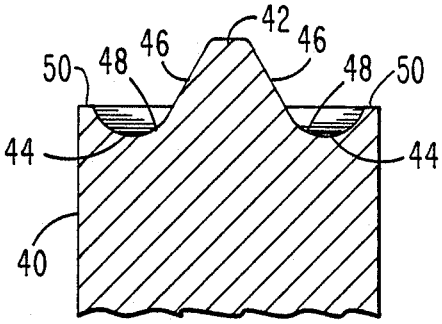
Fig. 3

PRINTED CIRCUIT BOARD WITH MOUNTED TERMINAL

BACKGROUND OF THE INVENTION

This invention pertains to a structure and method for mounting a conductive terminal in an aperture extending through a printed circuit board.

Conductive terminals are mounted in apertures extending through printed circuit (PC) boards. A typical conductive terminal has a shoulder portion, adjacent to a side surface of the terminal, which contacts one surface of the PC board, adjacent the aperture, for supporting a termination post utilized for making a connection to the terminal. The width of the conductive terminal disposed within the aperture is similar to that of the aperture so that the terminal forms a press fit connection with the aperture. The conductive terminal also has a bottom portion which flares outward to contact a conductive coating dospposed, adjacent the aperture, on the opposite surface of the board. In order to provide an electrical connection to the PC board, the bottom portion of the conductive terminal is soldered to the conductive coating.

In manufacturing laminated PC boards having a relatively small thickness, the aforementioned mounting technique has caused structural damage to the PC board and cracking or blistering of the conductive laminate, resulting in electrical discontinuity. Also, a lateral mechanical force exerted on the terminal can create a break in the electrical connection between the flared-out bottom portion and the conductive laminate. In addition, in those PC boards where the soldering step is eliminated, the spring back of the flared-out bottom portion tends not to provide a good dry electrical connection.

SUMMARY OF THE INVENTION

The present invention provides a structure and method of mounting a conductive terminal in an aperture extending through a laminated PC board which provides a positive mechanical connection between the terminal and conductive laminate and, thereby, achieves effective electrical continuity without the aid of solder. Specifically, according to the present invention, the terminal has a shoulder portion, adjacent a side surface of the terminal, which contacts one surface of the board adjacent the aperture, and a bottom portion which flares outward to contact a conductive coating disposed, adjacent the aperture, on the opposite surface of the board. The bottom portion is rolled over sufficiently to allow a distal end surface of the bottom portion, adjacent the side surface, to contact the conductive coating at an orientation wherein the distal end surface is substantially parallel to the coating.

BRIEF DESCRIPTION OF THE DRAWINGS

FIG. 1 is a cross-sectional view of an embodiment of a terminal mounting arrangement according to the present invention.

FIG. 2 is a cross-sectional view of the embodiment shown in FIG. 1 at an initial step of a method for forming the terminal mounting arrangement shown in FIG. 1.

FIG. 3 is a partial cross-sectional view of a tool utilized in performing the method described with respect to FIG. 2.

DETAILED DESCRIPTION OF THE PREFERRED EMBODIMENT

FIG. 1 of the drawings shows a conductive terminal 10 mounted in an aperture 12 extending through a printed circuit (PC) board 14. The terminal 10 has a shoulder portion 16 adjacent to a side surface 18. The shoulder portion 16 contacts one surface 20 of the PC board 14 adjacent the aperture 12, and supports a termination post 22 utilized for making an electrical connection thereto, such as by wire-wrapping. The post 22 can also be plugged into a female type of receptional or utilized as a test point in field servicing. The conductive terminal 10 also has a bottom portion 24 which flares outward to contact a conductive coating 26 disposed adjacent the aperture 12 on a surface 28 of the PC board 14 opposite the one surface 20. The conductive coating 26 may comprise a copper laminate which has been etched to form a contact area and is connected to other conductive coatings on the PC board 14 (not shown). A solder-resist pattern 30 is also shown for limiting solder application during a soldering step.

The bottom portion 24 of the conductive terminal 10 is rolled over sufficiently to allow a distal end surface 32 thereof, adjacent the side surface 18, to contact the conductive coating 26 at an orientation wherein the distal end surface 32 is substantially parallel to the coating 26. The bottom portion 24 is rolled over such that the contour of the side surface 18 changes direction by an amount greater than 100 degrees. Preferably, the contour of the side surface 18 changes direction by approximately 180 degrees and has a substantially constant radius of curvature, as shown in FIG. 1.

In the present embodiment, the conductive terminal 10 comprises a cylindrically-shaped tube having a substantially concentric cavity 34 in its bottom portion 24. For reasons explained below, it is desirable to have a clearance between the side surface 18 of the cylindrically-shaped tube and the edge 36 of the aperture 12. Preferably, this clearance is approximately equal to the thickness of the side 38 of the tube at the bottom portion 24, which is about 0.25 millimeter. As shown in FIG. 1, the side 38 of the cylindrically-shaped tube flares outward a distance equal to at least four times the thickness of the side 38.

FIG. 2 shows an initial step of the present method of mounting the conductive terminal 10 in the aperture 12 of the PC board 14. The unflared bottom portion 24 of the terminal 10 is first inserted into the aperture 12 until the shoulder portion 16 contacts the one surface 20 of the PC board 14. Then, while holding the terminal 10 firmly against the PC board 14 using a mounting fixture (not shown), the bottom portion 24 of the terminal is flared outward to contact the conductive coating 26. This flaring-out step is performed by utilizing a staking tool 40, one end of which is shown in FIG. 3. The staking tool 40 has a central peak section 42 surrounded by a curved valley section 44 which has a substantially constant radius of curvature, as shown in FIG. 3. The peak section 42 is inserted into the cavity 34 in the bottom portion 24 and thrust upward to contact the side 38 of the bottom portion 24. The tool 40 continues to move upward so that the side 38 is forced outward by first the expanding surface 46 at the base of the peak section 42 and then the curved surface 48 of the valley portion 44. The side 38 of the bottom portion 24 follows the contours of the expanding surface 46 and the curved surface 48 and is, thereby, rolled over sufficiently until the distal end surface 32 of the bottom portion 24 contacts the conductive coating 26. The movement of the staking tool 40 is stopped when it reaches the position shown by the dotted line in FIG. 1.

The rolled-over bottom portion 24 of the conductive terminal 10 forms a projecting annular ring wherein only the distal end surface 32 contacts the conductive coating 26. This rolled-over bottom portion 24 provides a positive mechanical connection between the terminal 10 and the conductive coating 26 due to the face that the contour of the side surface 18 at the bottom portion 24 has changed direction by an amount greater than 100 degrees. The significance of such a roll over is that the distal end surface 32 is bent beyond the vertical center line of the terminal 10 to an extent where the elastic limit of the conductive terminal 10 has been exceeded, thereby, causing a permanent deformation of the terminal 10 which prevents significant springback from the conductive coating 26. In other words, prior-art terminals having the conductive material simply swagged back against the surface of the conductive coating tended not to provide a good dry (solderless) electrical connection due to the springback of the conductive material (typically brass). In order to compensate somewhat for this undesirable springback, previous terminals were slightly upturned aginst the conductive coating. This causes the terminal to slightly dig into the conductive coating, which tends to cause structural damage to some PC boards due to the small permissible tolerance between the final position of the vertically moving swagging tool and the stationary conductive coating.

The rolled-over bottom portion 24 of the conductive terminal 10 minimizes the structural damage done to the PC boards 14 during the mounting operation. The shape of the rolled-over portion 24 reduces the sensitivity of the height adjustment in the vertical stroke of the staking tool 40 by providing a space into which the side 38 of the terminal 10 can move to absorb additional vertical movement by the staking tool 40. Thus, as the staking tool 40 continues to move upward, the side surface 18 of the terminal 10 will not dig into the conductive coating 26. The shape of the rolled-over portion 24 also minimizes the radial forces applied to the aperture 12 during the rolling-over step, which decreases the delamination and cracking of the conductive coating 26. By changing the direction of the contour of the side surface 18 by an amount greater than 100 degrees, the resulting upturn in the end of the bottom portion 24 transmits a radial force from the upturned portion 50 of the staking tool, which tends to counteract the radial force applied to the aperture 12 by the peak and valley sections 42 and 44 of the staking tool.

In order to further increase the yield of undamaged PC boards 14 during the terminal mounting operation, it is important that there be a significant clearance between the side surface 18 of the terminal 10 and the edge 36 of the aperture. It was observed that this rolling-over step could result in the cracking or blistering of the conductive coating 26 in a substantial number of PC boards 14 where the conductive terminal formed a press fit with the apertures 12. It was discovered that this cracking or blistering was greatly reduced when a significant clearance was present between the side surface 18 and the edge 36 during the rolling-over step. This clearance prevents the staking tool 40 from applying any radial force, via the side 38 of the terminal 10, to the edge of the conductive coating 26 which is adjacent the edge of the aperture 12.

The present invention provides a positive mechanical connection between the conductive terminal 10 and the conductive coating 26, which achieves effective electrical continuity without the need for solder. Such a positive mechanical connection to the PC board 14, makes it possible for such PC boards to safely carry high voltages and high currents including those typically carried in alternating current and deflection power lines utilized in television receivers.

What is claimed is:

1. In a printed circuit board including a conductive cylindrically-shaped tube mounted in an aperture extending therethrough, said tube having a shoulder portion adjacent a side surface thereof contacting one surface of said board adjacent said aperture and a bottom portion flaring outward to contact a conductive coating disposed adjacent said aperture on a surface of said board opposite the one surface, the improvement comprising:

said bottom portion being rolled over sufficiently to allow a distal end surface of the bottom portion adjacent said side surface to contact said conductive coating at an orientation wherein said distal end surface is substantially parallel to said coating, there being a clearance between the side surface of said cylindrically-shaped tube and the entire edge of both said aperture and said coating.

2. A printed circuit board as defined in claim 1 wherein the bottom portion of said conductive terminal is rolled over such that the contour of said side surface thereat changes direction by an amount greater than 100 degrees.

3. A printed circuit board as defined in claim 2 wherein the contour of said side surface at said bottom portion changes direction by approximately 180 degrees.

4. A printed circuit board as defined in claim 3 wherein the contour of said side surface at said bottom portion has a substantially constant radius of curvature.

5. A printed circuit board as defined in claim 4 wherein the bottom portion of said conductive terminal has a substantially concentric cavity therein.

6. A printed circuit board as defined in claim 2 wherein said clearance is approximately equal to the thickness of the side of said tube at said bottom portion.

7. A printed circuit board as defined in claim 6 wherein the bottom portion of said cylindrically-shaped tube flares outward a distance equal to at least four times the thickness of the side of said tube at said bottom portion.

8. In a method of mounting a conductive cylindrically shaped tube in an aperture extending through a printed circuit board including the steps of inserting said tube into said aperture until a shoulder portion of said tube adjacent a side surface thereof contacts one surface of said board adjacent said aperture, and flaring outward a bottom portin of said tube to contact a conductive coating disposed adjacent said aperture on a surface of said board opposite the one surface, the improvement comprising the step of:

rolling over said bottom portion sufficiently until a distal end surface of the bottom portion adjacent said side surface contacts said conductive coating at an orientation wherein said distal end surface is substantially parallel to said coating, there being a clearance between the side surface of said cylindrically-shaped tube and the entire edge of both said aperture and said coating.

9. A method as recited in claim 8 wherein said rolling over step is performed in a manner such that the contour of said side surface thereat changes by an amount greater than 100 degrees.

10. A method as recited in claim 9 wherein said rolling over step is performed in a manner such that the contour of said side surface at said bottom portion changes direction by approximately 180 degrees.

11. A method as recited in claim 10 wherein said rolling over step is performed in a manner such that the contour of said side surface at said bottom portion has a substantially constant radius of curvature.

* * * * *